United States Patent [19]

Appelbaum

[11] Patent Number: 4,718,259

[45] Date of Patent: Jan. 12, 1988

[54] KEYSAFE

[75] Inventor: Paul Appelbaum, Lakewood, Colo.

[73] Assignee: Hampton Lock Co., Inc., Denver, Colo.

[21] Appl. No.: 6,334

[22] Filed: Feb. 2, 1987

Related U.S. Application Data

[63] Continuation-in-part of Ser. No. 846,040, Mar. 31, 1986, abandoned.

[51] Int. Cl.[4] ..... E05B 65/52

[52] U.S. Cl. ..... 70/63; 70/52; 70/54; 70/55; 109/52

[58] Field of Search ..... 70/63, 52–56; 109/52–54, 45, 59

[56] References Cited

U.S. PATENT DOCUMENTS

| | | | |
|---|---|---|---|
| 2,047,969 | 7/1936 | Keil | 70/51 |
| 2,911,814 | 11/1959 | Williams | 70/63 |
| 3,084,008 | 4/1963 | Mallett | 70/63 |
| 3,204,436 | 9/1965 | Nemsky | 70/63 |
| 3,236,075 | 2/1966 | Williams | 70/63 |
| 3,695,067 | 10/1972 | Bays | 70/63 |
| 3,712,091 | 1/1973 | Parent | 70/63 |
| 3,727,438 | 4/1973 | Knaack | 70/63 |
| 3,835,675 | 9/1974 | Lippisch | 70/38 A X |
| 4,172,424 | 10/1979 | DePalau | 109/54 |
| 4,241,594 | 12/1980 | Miller et al. | 70/52 X |
| 4,573,332 | 3/1986 | Ma | 109/52 |
| 4,576,022 | 3/1986 | Gamble | 70/63 |
| 4,649,723 | 3/1987 | Appelbaum | 70/63 |
| 4,686,840 | 8/1987 | McCarroll | 70/54 |

FOREIGN PATENT DOCUMENTS

| | | | |
|---|---|---|---|
| 156072 | 6/1937 | Austria | 70/55 |
| 338405 | 6/1921 | Fed. Rep. of Germany | 70/55 |
| 775478 | 12/1934 | France | 70/52 |

*Primary Examiner*—Robert L. Wolfe
*Assistant Examiner*—Suzanne L. Dino
*Attorney, Agent, or Firm*—Charles C. Corbin

[57] ABSTRACT

Keysafe having a main storage case of spaced apart opposing walls in which is affixed a padlock with its shackle extending through the top wall of the case and with the padlock opening for receiving the free end of the shackle oriented towards the front of the case, and a lid for covering the front part of the case that is locked closed when the free end of the padlock shackle is locked in place.

6 Claims, 6 Drawing Figures

Fig. 1.
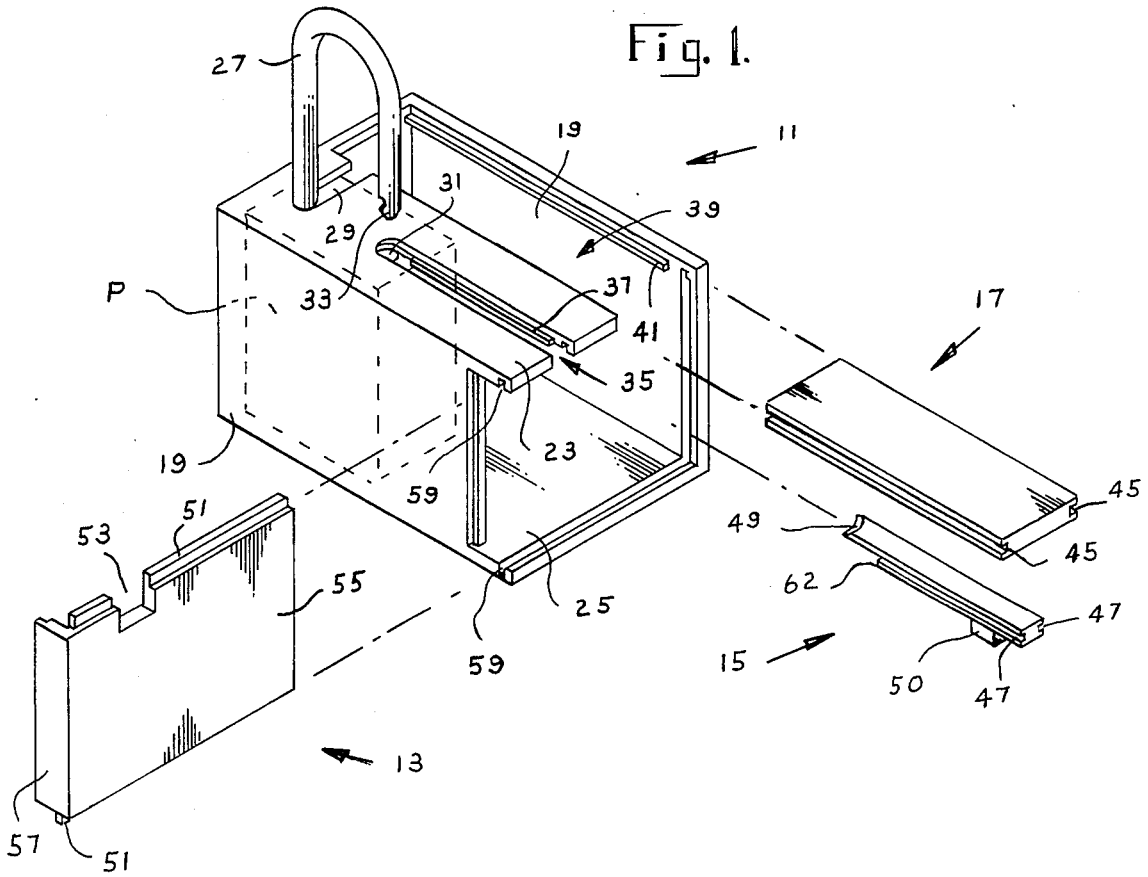
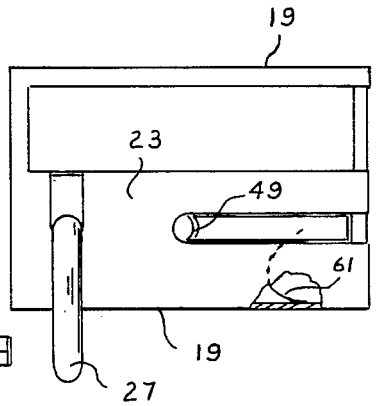
Fig 3
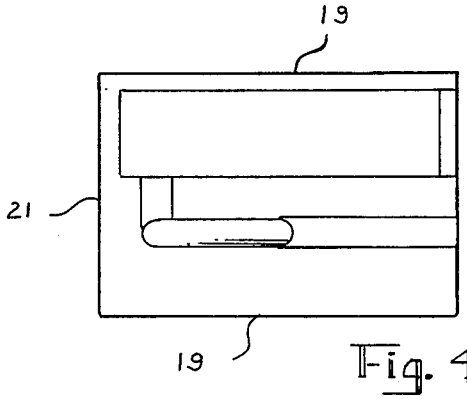
Fig. 4
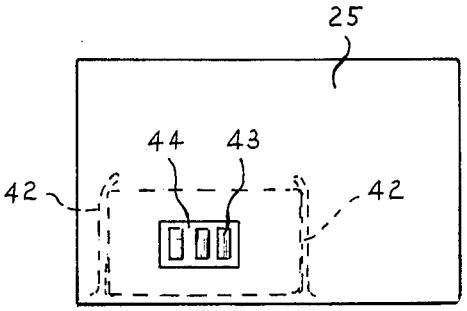
Fig. 2

KEYSAFE

This is a continuation-in-part of application Ser. No. 846,040, filed Mar. 31, 1986, now abandoned.

BACKGROUND

A conventional keysafe device has a locking mechanism which employs a shackle for attaching the safe to a fixed object, as well as another latch for securing and unlocking the storage compartment. A keysafe that uses only a single locking means will tend to lower manufacturing costs and provide the consumer with a more inexpensive item.

SUMMARY OF THE INVENTION

In view of the foregoing it is an object of the present invention to provide a portable keysafe in which latching of the means for securing the safe to a fixed object also functions to secure the storage compartment.

Another object of the invention is to provide a portable keysafe having a construction which lends itself to employing a conventional padlock.

A further object is to provide a keysafe that convienienty performs the securing functions of a padlock.

These and other objects and advantages will become evident from a reading of this summary, and by reference to the detailed description and drawings which follow thereafter.

Accordingly the present invention provides a keysafe having a storage case that has a top wall, bottom, and spaced apart side walls, with a padlock mounted within the confines of the case with its shackle extending upwardly through openings in the case top. The space remaining within the case is storage space. An opening on the case bottom provides access to the keyway of the padlock. The invention features a lid mounted to a forward end of the case that has a compartment closing position and a compartment opening position and which lid is adapted to be locked closed when the padlock shackle is locked.

BRIEF DESCRIPTION OF THE DRAWINGS

FIG. 1 is an exploded isometric view of a keysafe according to the invention;

FIG. 2 is a bottom view of the device shown in FIG. 1;

FIG. 3 is a top view of the device shown in FIG. 1 with padlock unlocked;

FIG. 4 is a top view of the device of FIG. 1 with padlock locked;

DETAILED DESCRIPTION

Figure 5:
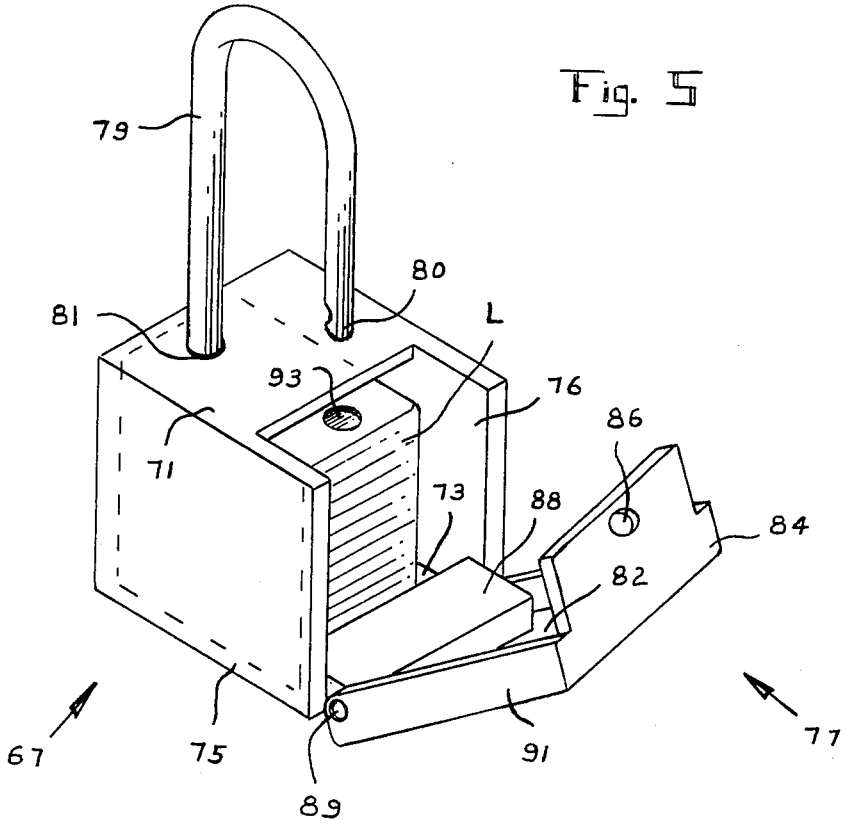
FIG. 5 is an isometric view of another embodiment of the invention.

A keysafe according to the invention is shown in FIG. 1 with its main components- the padlock P, a main case 11, lid 13, latach bar 15 and hatch 17 shown in exploded view to illustrate their salient features and the method of assembly thereof. These components are preferrably formed of stainless steel or aluminum alloy by various fabrication techniques well known in the metal working industry. The main case 11 has spaced apart side walls 19, rear wall 21, top 23 and bottom 25. Padlock shackle 27 extends through slotted opening 29 in top 23, and hole 31 allows passage of tapered shackle tip 33 for locking of padlock P. A longitudinal slot 35 with tongues 37 extends forwardly from hole 31. Top 23 also has a larger longitudinal slot 39 with bodering tongues 41. A pair of resilient arms 42, shown in FIG. 2, and not shown in FIG. 1 for the sake of clarity, releasably embrace padlock P.

As FIG. 1 shows, the hatch 17 has side grooves 45, and the latch bar 15 carries grooves 47 and features a cammed surface 49 on its rear end. A stop 50 depends from the bottom of latch bar 15. The lid 13 has transverse top and bottom tongues 51, a latch slot 53 in front wall 55 and a side lip 57. There are transverse grooves 59 extending along the forward ends of the top 23 and the bottom 25.

In the assembly of the device of FIG. 1 the padlock P is placed within case 11 by way of slot 39. Slot 29 will pass the shackle 27 and allow padlock P to be snapped in place within arms 43. Hatch 17 may then be slidably attached to case 11 to completely cover slot 39 with tongues 41 engaging hatch grooves 45. Similarily the grooves 47 of latch bar 17 engage tongues 37 so that latch bar 17 sits within the slot 35 as shown in FIG. 3. A hair spring 61 that extends from case wall 19 to the latch bar 15, and which is attacked by welding, biases the latch bar 15 rearwardly. A ledge 62 abuts with the forward wall of padlock P to limit the rearward movement of latch bar 15 and to position the cammed surface 49 within the hole 31 as FIG. 3 illustrates. This is the open position for the latch bar 15, with its front end lying just behind the groove 59.

In the use of the keysafe device of FIG. 1 small items such as keys and currency may be placed within the confines of case 11. With padlock P unlocked as illustrated in FIG. 1 and FIG. 3 the lid 13 may then be slid into place to fully close the case 11 with lid tongues 51 engaging the grooves 59. In the closed position shown in FIG. 3 the latch slot 53 is aligned with the latch bar 15. The shackle 27 may then be secured around a fixed article such as a door latch when the invention is to function in the manner of keysafes, or it may be utilized in all the ways that conventional padlocks are employed to lock things.

When the tapered tip 33 of shackle 27 passes through hole 31 during the locking of padlock P, it engages the cammed surface 49 of latch bar 15 and urges latch bar 15 forward to the position shown in FIG. 4 where it has engaged the latching slot 53 to thereby lock lid 13 against movement. The stop 50 will abut against the inner side of front wall 55 to prevent any further forward movement of latch bar 15.

It is noted that padlock P is of conventional design and preferrably has a resettable combination mechanism with knobs 43 located at its bottom wall. As FIG. 2 shows the slot 44 in case bottom 25 permits access to knobs 43.

When padlock P is unlocked and shackle tip 33 removed from hole 31, the latch bar 15 is urged rearwardly by spring 61, out of engagement with latching slot 53, so as to release lid 13.

Figure 6:
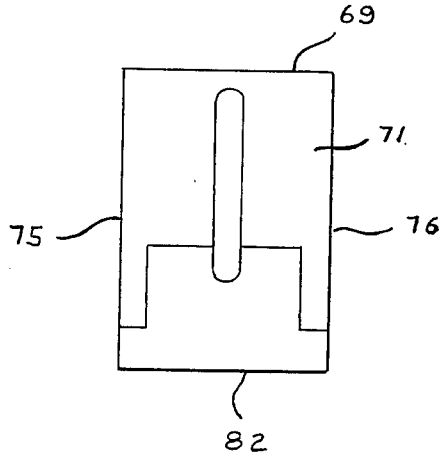
FIG. 6 is a top view of the embodiment shown in FIG. 5.

FIGS. 5 and 6 show a varient of the invention that has main case 67 with rear wall 69, top 71, bottom 73, and spaced side walls 75 and 76; and lid 77. A padlock L of conventional design and preferrably having a resettable combination mechanism with combination knobs (not shown) on its bottom is fastened within case 67 with one of its sides lying adjacent side wall 75. This provides a storage space between the sidewall 76 and the other side of padlock L. Shackle 79 which has free end 80 emerges through opening 81 in case top 71. The lid 77, which includes a front wall 82 and top 84 with hole 86, is pivotally mounted to reinforced front portion 88 by means of pin 89 which extends through a bore in portion 88. The outer ends of pin 89 are welded to the sides 91 of lid 77.

When lid 77 is rotated to the closed position shown in FIG. 6 the lid hole 86 is aligned above the padlock hole 93 and the spacing between adjoining edges of case 67 and lid 77 is close in order to prvent egress to case 67. Lid 77 is locked closed when the shackle free end 80 passes through lid hole 86 and into locking engagement within padlock hole 93. The case bottom 73 has an opening, not shown, similar to the opening in the keysafe bottom 25 of FIG. 2, to permit access to the combination knobs, not shown, of padlock L.

Various other modifications and advantages of the above described embodiments will be apparent to those skilled in the art and may be made without departing from the spirit and scope of the invention.

What is claimed is:

1. Keysafe comprising:

a. main storage case having top wall, spaced apart side walls, rear wall, and a bottom wall;

b. padlock affixed within said main case with the shackle of said padlock extending through the top wall of said case and with the padlock opening for receiving the free end of said shackle being located towards the front end of said case, and a channel in said top wall extending from said opening to the front edge of said top wall;

c. latch bar which is biased rearwardly and slidably mounted for movement along said channel, said bar having a cammed rear end that lies partially within said top wall opening when said shackle free end is not received in said opening and a stop that depends from the bottom of said latch bar and abuts against the inner wall of a lid, to prevent further movement of said latch bar and lid; and d. lid which is slidably mounted to the front end of said case for movement for opening and closing the front of said case, said lid having means thereon for receiving, when it is closed over the front of said case, the front end of said latch bar to hold said lid against sliding motion, said lid holding engagement occuring when said shackle free end is moved into said opening and downwardly to engage said cammed rear end of said latch to urge said latch into engagement with said latch receiving means.

2. Apparatus as defined in claim 1 wherein said lid means for receiving the front end of said latch comprising an opening along the upper part of said lid.

3. Apparatus as defined in claim 1 wherein said lid is mounted for horizontal movement.

4. Apparatus as defined in claim 1 wherein said padlock lies adjacent a side and the rear wall of said case.

5. Apparatus as defined in claim 1 wherein the padlock has a resettable combination mechanism and the bottom of said case is adapted to provide access to the combination knobs of said mechanism.

6. Apparatus as defined in claim 1 wherein said top wall has a first slot therein that extends substantially the length of said top wall to the front edge thereof, said slot communicating via a second slot with opening in said top wall for receiving the unfree end of said shackle, and a cover slidably mounted in said first slot and adapted to be retained fully therein when said lid is closed.

* * * * *